US011818816B2

(12) United States Patent
Niggebaum et al.

(10) Patent No.: US 11,818,816 B2
(45) Date of Patent: Nov. 14, 2023

(54) DRIVER EXPANSION MODULE FOR RETROFITTING A DRIVER

(71) Applicant: LEDVANCE GmbH, Garching bei Munchen (DE)

(72) Inventors: Alexander Niggebaum, Munich (DE); Krister Bergenek, Regensburg (DE); David Chilachava, Munich (DE)

(73) Assignee: LEDVANCE GMBH, Garching bei Munchen (DE)

( * ) Notice: Subject to any disclaimer, the term of this patent is extended or adjusted under 35 U.S.C. 154(b) by 147 days.

(21) Appl. No.: 17/462,120

(22) Filed: Aug. 31, 2021

(65) Prior Publication Data

US 2022/0078894 A1 Mar. 10, 2022

(30) Foreign Application Priority Data

Sep. 7, 2020 (DE) ..... 102020123333.7

(51) Int. Cl.

| | |
|---|---|
| ***H05B 45/18*** | (2020.01) |
| ***H05B 47/19*** | (2020.01) |
| ***H05B 45/345*** | (2020.01) |
| ***H05B 47/18*** | (2020.01) |

(52) U.S. Cl.

CPC ..... *H05B 45/18* (2020.01); *H05B 45/345* (2020.01); *H05B 47/18* (2020.01); *H05B 47/19* (2020.01)

(58) Field of Classification Search

CPC ..... H05B 45/10; H05B 45/18; H05B 45/30; H05B 45/345; H05B 47/10; H05B 47/18; H05B 47/19

See application file for complete search history.

(56) References Cited

U.S. PATENT DOCUMENTS 10,887,965 B1 * 1/2021 Chen ..... H05B 45/40

* cited by examiner

*Primary Examiner* — Jimmy T Vu
(74) *Attorney, Agent, or Firm* — Hayes Soloway PC

(57) ABSTRACT

A driver expansion module for retrofitting a driver with at least one adjustable output parameter is provided. The driver expansion module comprises an interface for connecting the driver expansion module to the driver, and a control unit, wherein the control unit is configured to send a control signal to a control input of the driver to adjust the at least one output parameter of the driver. A driver is further provided, as well as a driver system and a light management system.

20 Claims, 10 Drawing Sheets

$FG_{standalone}$

DRIVER EXPANSION MODULE FOR RETROFITTING A DRIVER

CROSS-REFERENCE TO RELATED APPLICATION AND PRIORITY

This patent application claims priority from German Patent Application No. 102020123333.7, filed on Sep. 7, 2020, which is herein incorporated by reference in its entirety.

TECHNICAL FIELD

The present disclosure relates generally to electrical drivers. More specifically, the present disclosure relates to driver expansion modules for retrofitting a driver.

BACKGROUND

Electrical drivers for providing an output current or an output voltage, in particular for controlling an electrical load, are known. For some control applications of drivers, in particular LED drivers, precise control of the output current or output voltage is required. For example, relatively small deviations in output parameters of LED drivers can lead to impairments in the quality of the light generated by an LED light engine. In particular in applications where precise colour mixing of light generated by different coloured LEDs is important, such as museum lighting, these deviations in output parameters of drivers, but also aging processes and manufacturing tolerances in LEDs, can lead to a noticeable deterioration of the light quality. In order to still achieve precise colour mixing, high-precision adjustable drivers are used, but this is usually associated with high costs.

SUMMARY

An object of the embodiments of the present disclosure is to provide a low cost means of monitoring output parameters of electrical drivers.

According to a first aspect, a driver expansion module for retrofitting a driver or a drive module with at least one adjustable output parameter is provided to solve this object. The driver expansion module comprises an interface for connecting the driver expansion module to the driver, and a control unit or logic, wherein the control unit is configured to send control signals to a control input of the driver to adjust the at least one output parameter of the driver. In particular, the control unit may comprise a microcontroller having a processor for processing data, a memory unit for storing data and machine-readable codes for the processor, and an interface for connecting the control unit to the communication bus. The control unit or the microcontroller may further comprise one or more further interfaces, in particular for configuring digital inputs and outputs and/or for translating measurement signals. Configuring the control unit to perform certain actions means in this context that corresponding data and/or machine-readable instructions for the processor are stored in the memory unit of the control unit to perform these actions.

In particular, the driver can be designed as an LED driver, in particular for driving an LED light engine. The at least one output parameter of the driver can comprise an output current and/or an output voltage or output power of the driver. The data stored in the memory unit may in particular contain LED-specific data, such as aging data of the LEDs used in an LED light engine. With the driver expansion module, the at least one output parameter of the driver, which can basically be designed as a standard driver, can thus be adapted taking into account the LED-specific data of the LED light engine or taking into account the aging processes of the LEDs, without having to replace the driver with a special high-quality driver for this purpose. By subsequently adapting the at least one output parameter, a subsequent passive control or correction of the at least one output parameter of the driver can thus be achieved on the basis of the data stored in the memory unit.

In particular, the driver extension module can be designed to be connected to an output side of the driver in such a way that the at least one output parameter, in particular the output current and/or output voltage, is passed on to the consumer or to the LED light engine by the driver extension module.

In some embodiments, the driver extension module may comprise a sensor system or measuring device for detecting or monitoring a current value of the at least one output parameter, wherein the control unit may be configured to adjust the at least one output parameter of the driver based on the detected current value.

With the driver extension module, a driver which itself does not have a device for monitoring its output parameters and/or adjusting them can be easily extended by these functions, in particular monitoring or active adjustment or correction of output parameters. The monitoring of the driver output or of the at least one output parameter of the driver can also be used to compensate for any offsets that may occur, in particular due to component tolerances. Thus, drivers that do not originally provide for compensation of this offset can be easily retrofitted with the help of the driver expansion module for offset correction. By retrofitting the driver with the driver extension module, the driver can be upgraded to meet requirements applicable to higher product classes. The development of custom variants of drivers for any additional function can be avoided by using the driver extension module, as the additional functions are provided by the driver extension module connected to a standard driver.

With the driver expansion module, it is possible to achieve precise output currents or voltages without changing the driver design. In particular, it is not necessary to use high-quality or highly intelligent drivers with special driver designs. In particular in such cases, when only small quantities are expected, this is associated with high extra costs, as such drivers have to be specially developed and are typically more complex than drivers without this function. Also, precise calibration measurements or active correction of drivers at the production line, which are also associated with high costs, can be avoided by retrofitting the drivers with the driver extension module.

In some embodiments, the control unit is designed to adjust or regulate the at least one output parameter both passively and actively, wherein the driver extension module can be designed in such a way that it is possible to select or switch between the two operating modes, depending on the application. In particular, the switching between the operating modes can be carried out by the user's intervention or also automatically if, in particular, the control unit does not receive the information required for active control, in particular about the consumer.

The driver extension module may be adapted to serve drivers with multiple output channels or multi-channel drivers, so that the control or correction function can be performed for one, two, more than two or all output channels of the multi-channel driver. In particular, the driver extension module may be configured to correct or stabilise only a portion of the driver or only a subset of all output channels of a multi-channel driver. For example, in a system, in particular in a luminaire system or LMS (Light Management System), with more than one driver or more than one driver channel, the correction of the at least one output parameter can be carried out independently of the number of driver channels, in particular in an application-specific or cost-optimised manner.

The control unit can be configured to determine or calculate a current value of a junction temperature (JT) or temperature of a semiconductor junction of an LED, in particular of an LED light engine, on the basis of an output voltage of the driver detected by the sensor system and to adjust the at least one output parameter of the driver based on the current value of the JT. By taking the JT of the LED into account, any temperature dependencies of LED parameters can be taken into account when controlling the LED light engine. In particular, LEDs can have different temperature-related colour location shifts depending on the material class, phosphor combination and CCT (Correlated Color Temperature). The information about the current values of the JT of the LED can be used to compensate for the temperature-dependent colour location shifts in light engines with LEDs of different colours that are driven, for example, by output currents of different output channels of the driver, by adjusting the output currents.

The driver extension module may be configured to communicate with another compatible or the same or similar driver extension module for exchanging data and/or signals. In particular, the driver extension module may include a communication interface for wireless and/or wired communication such that communicating with the other driver extension module may be performed via the communication interface. The ability to exchange data and/or signals or messages with another driver extension module enables coordinated operation of multiple driver extension modules, particularly in a system with two or more drivers or multi-driver system.

The driver extension module can be configured to communicate with another driver extension module via a network interface of the driver for connecting the driver, in particular via a communication bus, to a base module of a network setup. Thus, networks of such drivers retrofitted with driver extension modules can be provided, which enable a coordinated cooperation of the drivers among each other.

According to a second aspect, a driver having at least one adjustable output parameter is provided. The driver comprises an interface, in particular a control interface, for connecting a driver expansion module, in particular according to the first aspect, and a control input for receiving a control signal from the driver expansion module, wherein the driver is configured to adjust the at least one output parameter based on the control signal received from the driver expansion module.

The driver may in particular comprise a network interface for connecting the driver to a base module of a network assembly via a communication bus, in particular via an internal communication bus. The base module of the network assembly may in particular comprise a logic unit configured to be connected to the communication bus, in particular to an internal communication bus of the network assembly, for providing communication between the logic unit and one or more expansion modules or peripherals, in particular one or more functional devices and/or communication modules, for function expansion or function provision of the network assembly.

In particular, the communication bus can be designed to transmit data or signals between the logic unit and the expansion modules. In some embodiments, the communication bus is designed to supply one or more expansion modules with electrical energy. In particular, the communication bus can comprise signal lines for serial communication or transmission of messages and/or supply lines for power supply of the expansion modules or peripherals. In some embodiments, the communication bus is formed as part of the base module. In particular, the communication bus can be designed to be connected to a plurality of functional devices and/or communication modules as expansion modules in order to provide desired functionalities.

In particular, the logic unit represents the central module or node of such a network structure, via which, in particular, all network communication within the network structure can take place. The logic or the logic unit thus plays the central role in such a modular network structure. The logic unit can transmit, process and/or change information according to the intended operating scenarios. In particular, the logic unit can comprise a microcontroller with a processor for data processing, with a memory unit for storing data and machine-readable codes for the processor, and with an interface for connecting the logic unit to the communication bus. The logic unit or the microcontroller of the logic unit may further comprise one or more further interfaces, in particular for configuring digital inputs and outputs and/or for transforming measurement signals. Configuring the logic unit to perform certain actions means in this context that corresponding machine-readable instructions for the processor are stored in the memory unit of the logic unit to perform these actions.

The logic unit can be configured in such a way that communication via the communication bus between the logic unit and the expansion modules can take place, in particular exclusively, via a system-internal or proprietary communication protocol. The system-internal communication protocol can in particular make unauthorised access to the communication bus of the network structure more difficult or prevent it. In particular, the use of the system-internal or proprietary communication protocol can make it more difficult or prevent the connection of non-certified or non-approved expansion modules to the base module. Thus, the communication bus can serve as a protected, proprietary interface or ILB (Intra Luminaire Bus) for the exchange of data or messages between the logic unit and the expansion modules or peripherals.

The functional devices or peripherals may in particular include sensor systems or various sensors, drivers, in particular LED drivers, push buttons and/or further devices. In the case of a luminaire, a functional device can be designed to detect or control the amount of light produced by the luminaire. In particular, a luminaire may comprise one or more light sources. In particular, a luminaire may comprise a light source for generating an indirect light, such as in a diffusely illuminating luminaire, and a light source for generating a direct light, such as in a light emitter. In this case, the control of the amount of light can be carried out directly via the logic unit or via the LMS in which the luminaire is integrated. The functional devices can also be used for data acquisition and/or transmission to the LMS. For example, the functional devices can include $CO_2$ and/or temperature sensors, detect or monitor the current $CO_2$ concentration or temperature value, and provide the detected data, for example for the purpose of building maintenance or servicing. Furthermore, this information can be used to optimise energy consumption or to increase the efficiency of operating processes.

The one or more communication modules may comprise a module designed for wireless communication. The extension module may in particular comprise a ZigBee, Bluetooth, DALI interface. ZigBee® is a registered trademark of the ZigBee Alliance. Bluetooth® is a registered trademark of the Bluetooth Special Interest Group. DALI® (Digital Addressable Lighting Interface) is a registered trademark of the International Standards Consortium for Lighting and Building Automation Networks. By using standardised interfaces, functional devices connected to the communication module can be remotely controlled or integrated into an LMS via standard protocols. In particular, the communication module can be designed to act as an interpreter between the logic unit and the LMS by communicating with the LMS via a standard protocol and communicating with the logic unit via the internal or proprietary protocol of the communication bus. An LMS enables customers to control different luminaires individually or in groups and to define lighting scenes ranging from simple to complex. An extension module can also be a communication module and a functional device at the same time, for example a ZigBee module with an integrated PIR sensor (Passive Infrared Sensor).

Due to the connectivity of the logic unit via the communication bus with one or more expansion modules, the network structure around the logic unit as central unit or base module can be modularly and flexibly expanded. Thus, an intelligent luminaire bus system can be realised by means of the base module, which allows the customer to determine the functionality, complexity and costs of control gear or luminaires and to adapt them to his own needs. In particular, the base module represents a design platform that allows functional devices to be used freely and flexibly, if necessary in compliance with any norms, standards and requirements in the desired device network or light management system.

The logic unit can be configured to search for an expansion module connected to the communication bus via the communication bus. This search function allows the logic unit to determine if an extension module or a further extension module has been connected to the communication module and to react accordingly if necessary. The logic unit may be configured to configure an expansion module for the communication bus if the search determines that the expansion module is connected to the communication bus. In particular, the logic unit may automatically configure a communication module connected to the communication bus as intended, so that, for example, configuring a communication module automatically initialises the network setup for an LMS.

The logic unit of the base module can have a further interface, in particular a plug & play interface, in particular for connecting a plug & play functional unit or a functional device that can be directly controlled by the logic unit via control signals. For example, an LED driver without microcontroller-based intrinsic intelligence can be connected to the plug & play interface and directly controlled by the logic unit. In such a case, the variables of the LED driver set at the factory can be stored directly in the logic unit. Intelligent LED drivers that have their own microcontrollers can be connected to the communication bus or ILB interface.

In addition to the base module, the network assembly can comprise one or more extension modules, in particular one or more functional devices and/or communication modules, for function extension or for function provision of the network assembly, which can be connected to the communication bus for providing communication between the logic unit of the base module and the one or more extension modules. The modular design of the network assembly allows the network assembly to be easily upgraded or retrofitted with expansion modules. The network assembly may comprise at least one light source, in particular at least one LED light source, and at least one driver, in particular an LED driver, for driving the at least one light source, wherein the at least one driver may be designed as a functional device connectable to the communication bus. In particular, the network assembly may be designed as a luminaire. Such a luminaire can be easily equipped with additional functions by connecting additional extension modules, such as additional functional devices and/or communication modules, to the communication bus. The network construction may further comprise a plug-&-play LED driver that is connected to the plug-&-play interface of the logic unit and can be directly controlled by the logic unit. Thus, simple LED drivers that are not able to communicate with the logic unit via the system's internal communication bus can be directly controlled by the plug & play interface. The at least one expansion module can comprise at least one communication module for connecting the network structure, in particular via a standardised protocol, to a network system or LMS. In particular, the at least one communication module can be designed as a communication module for wireless communication with a network system or LMS.

An extension module of the network structure can be configured by means of the logic unit, wherein the method comprising a search, in particular by the logic unit, for an extension module connected to the communication bus. This search function enables the logic unit to determine whether an extension module or a further extension module has been connected to the communication module in order to react accordingly, if necessary. The method further comprises configuring an expansion module for the communication bus if the search reveals that the expansion module has been connected to the communication bus. Thus, the logic unit may automatically configure an expansion module connected to the communication bus as intended, so that, for example, configuring an expansion module may automatically initialise the network setup for an LMS. The method may comprise querying whether the extension module found in the search is a communication module, wherein the extension module may be determined to represent a functional device present in the network setup by the communication module in a network if the query determines that the extension module found in the search is a communication module. A communication module connected to the communication bus can thus be automatically configured to connect the network assembly to the network, in particular LMS, if necessary. Representing may comprise notifying the communication module of the type of functional device present. Thus, if applicable, the information about the type of functional device may be automatically communicated to the network, in particular LMS, via the communication module. The method may further comprise sending network-relevant or -necessary factory settings of the functional device to the communication module. Thus, if necessary, the information about the factory settings of the functional device can be automatically transmitted to the network, in particular LMS, via the communication module.

In cases where the network structure comprises an extension module designed as a luminaire, the network structure allows the luminaires to be calibrated subsequently, in particular after an intended installation. In particular, the calibration data can be recorded on a luminaire of the same type and transmitted to the network structure via an extension module designed as a communication module, in particular a communication module with online capability. Thus, such luminaires can be subsequently calibrated independently of the installation and manufacturer.

According to a third aspect, a driver system is provided. The driver system comprises a first driver having at least one adjustable output parameter, wherein the first driver having an interface for connecting a first driver expansion module, and a control input for receiving a control signal from the first driver expansion module for adjusting the at least one output parameter. The driver system further comprises a second driver having at least one adjustable output parameter, wherein the second driver having an interface for connecting a second driver expansion module and a control input for receiving a control signal from the second driver expansion module for adjusting the at least one output parameter, wherein the first driver is configured to drive a first electrical load and the second driver is configured to drive a second electrical load. The first driver expansion module and the second driver expansion module, respectively, may be particularly configured according to the first aspect of the present disclosure described above. In particular, the first driver and the second driver may be configured to drive a first light engine and a second light engine, respectively. In particular, the first driver and the second driver may be configured as LED drivers for driving a first LED light source or LED light engine and a second LED light source or LED light engine, respectively. The driver system thus allows simultaneous control of different LED light engines.

The first driver expansion module and/or the second driver expansion module may, in particular, each comprise a sensor system for detecting or monitoring a current value of at least one output parameter of the first or the second driver, respectively, wherein the first driver expansion module or the second driver expansion module, respectively, may be configured to adjust the at least one output parameter of the first or the second driver, respectively, based on the detected current value of the at least one parameter. For the drivers that do not themselves have a device for monitoring output parameters and/or adjusting them, these functions can be easily provided in an expanded manner in the course of retrofitting with the driver expansion modules.

The first driver extension module and the second driver extension module may further be configured to communicate with each other for exchanging data and/or signals, in particular via an interface for wireless and/or wired communication. Due to the ability to exchange data and/or signals or messages between the first driver extension module and the second driver extension module, the driver system allows the first driver and the second driver to be driven in a coordinated manner.

The driver system may further comprise a network assembly having a base module and having a communication bus, in particular an internal communication bus, in particular according to one of the network assemblies described above, wherein the first driver and the second driver are connected to the communication bus of the network assembly, so that communication between the first driver extension module and the second driver extension module can take place via the first driver, via the second driver and via the communication bus of the network assembly. By connecting the drivers to the network assembly, the network capability of the drivers can be improved so that the drivers can be connected to an LMS using the network assembly.

The first driver extension module may be configured to send a control signal to the second driver extension module that causes the second driver extension module to drive the second driver based on the control signal received from the first driver extension module. In particular, the first driver extension module may comprise a logic or driver system logic unit adapted to control the second driver extension module. The driver system logic unit can in particular be part of the control unit of the first driver extension module or be implemented in the control unit in terms of software and/or hardware.

The first driver extension module and the second driver extension module may each comprise a sensor system, wherein the second driver extension module may be configured to transmit sensor data sensed by the sensor system of the second driver extension module to the first driver extension module, and wherein the first driver extension module may be configured to send control signals to the second driver extension module that cause the second driver extension module to control the second driver based on the sensor data sensed by the sensor system of the first driver extension module and the sensor system of the second driver extension module.

The controllability of the second driver extension module by the first driver extension module creates a clear hierarchical ranking between the driver extension modules, which may facilitate coordinated cooperation between different drivers. The second driver extension module may also have a lower complexity than the first driver extension module. This is because the majority of the computational power is carried by the first driver expansion module. Thus, cost-optimised driver systems can be provided, in particular with a more powerful driver extension module or master module and a less powerful module or slave module.

According to a further aspect, an LMS (Light Management System) is provided. The LMS comprises a first light source, in particular a first LED light source or LED light engine, a second light source, in particular a second LED light source or LED light engine, and a driver system according to one of the aspects described above, wherein the first driver of the driver system is designed to drive the first light source and the second driver of the driver system is designed to drive the second light source, and wherein the LMS comprises a network structure with a base module and a communication bus to which the first driver and the second driver are connected. Due to the retrofittability of the drivers with the driver expansion modules, such an LMS is characterised by high functionality and low cost.

BRIEF DESCRIPTION OF THE DRAWINGS

The invention is now explained in more detail with the aid of the attached figures. The same reference signs are used in the figures for identical or similarly acting parts.

DETAILED DESCRIPTION OF THE DRAWINGS

Figure 1:
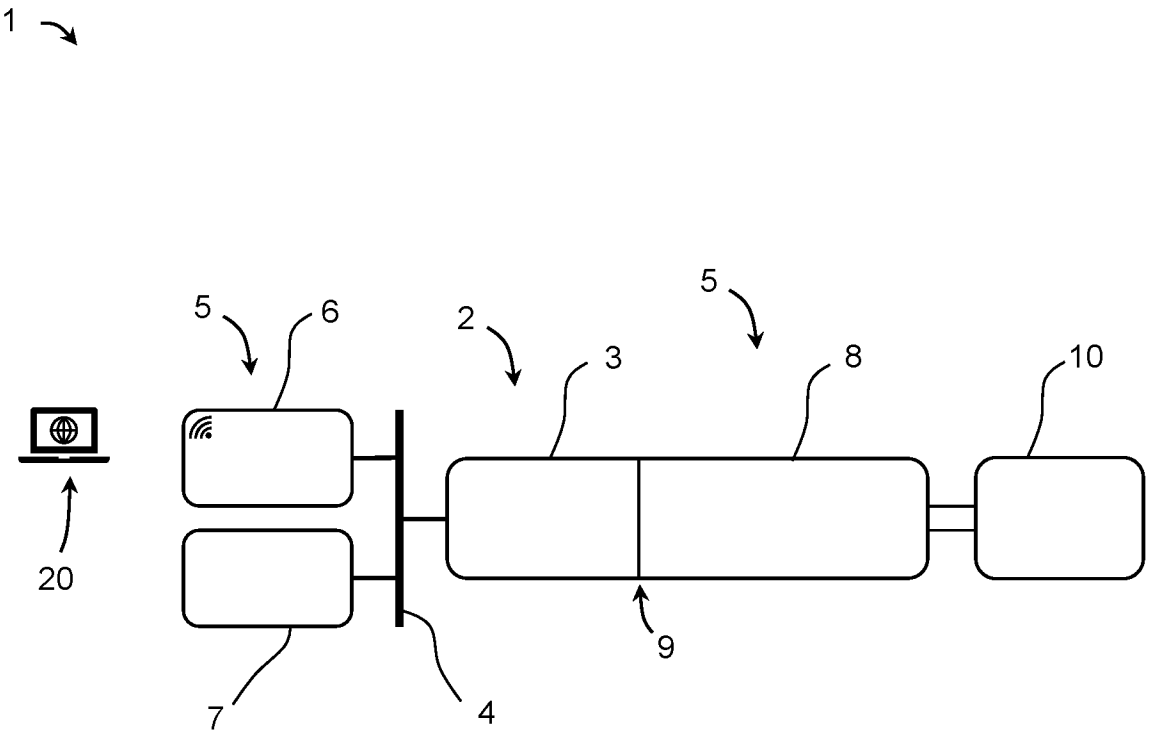
FIG. 1 schematically shows a network structure according to an embodiment.

FIG. 1 schematically shows a network structure according to an embodiment. The network structure 1 comprises a base module 2 with a logic unit 3, a communication bus 4 and extension modules 5 which are functionally connected to the logic unit 3. In the embodiment of FIG. 1, there are three extension modules 5 that are connected to the logic unit 3. An extension module 5 in the form of a Zigbee module 6 and an extension module 5 in the form of a sensor module 7 are connected to the logic unit 3 via the communication bus 4. An extension module 5 in the form of an LED driver 8 is connected to the logic unit 3 via an interface 9. FIG. 1 also shows a light source 10 which is electrically connected to the LED driver 8 and can be controlled by the LED driver 8. The Zigbee module 6 is designed to be connected to an LMS 20 (shown symbolically in FIG. 1).

Figure 2:
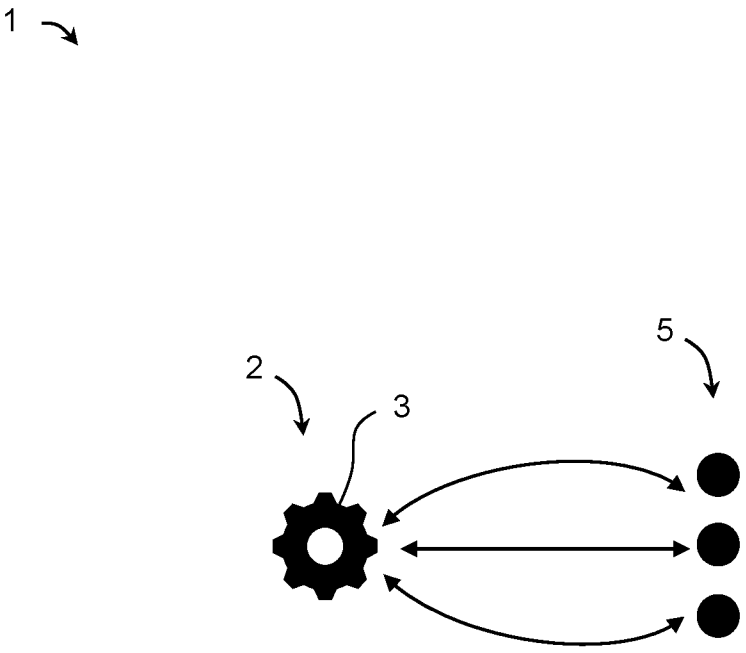
FIG. 2 schematically shows a network structure according to a further embodiment, FIG. 3 schematically shows a network structure according to another embodiment, FIG. 4 schematically shows a network structure according to a further embodiment, FIG. 5 schematically shows a network structure according to another embodiment.

FIG. 2 schematically shows a network structure according to a further embodiment. The network structure 1 of FIG. 2 comprises a base module 2 with a logic unit 3 and extension modules 5, which are in a functional connection with the logic unit 3. The functional connection between the logic unit 3 and the extension modules 5 is shown schematically by double-sided arrows. The extension modules 5 can be functional devices as well as communication modules. In this embodiment, the network assembly 1 represents a standalone luminaire, wherein one of the extension modules 5 is designed as an LED driver for light control of the luminaire.

The extension modules 5 are connected to the logic unit 3 via a communication bus (not shown in FIG. 2) similar to FIG. 1. In particular, the logic unit 3 may be configured such that the functional connection or communication via the communication bus between the logic unit 3 and the expansion modules 5 may be via a system-internal or proprietary communication protocol. In some embodiments, all expansion modules 5 are connected to the logic unit 3 exclusively via a proprietary communication bus. In some embodiments, the logic unit 3 has an additional interface, in particular a plug & play interface, to which in particular an LED driver can be directly connected. The plug & play interface can be designed as a protected proprietary interface so that the use of non-approved or non-qualified LED drivers or other expansion modules can be prevented. In particular, the logic unit 3 can be configured in such a way that an LED driver that does not have microcontroller-based intrinsic intelligence can be connected directly to the plug-&-play interface. In such a case, any factory-set variables of the LED driver can be stored directly in the logic unit so that the LED driver can be controlled directly by the logic unit 3. For the LED driver or for further expansion modules 5, which have their own intelligence or their own microcontroller, the connection to the logic unit 3 is possible via the communication bus 4. The logic unit 3 can be designed to search for expansion modules 5 or peripherals via the communication bus and to receive, process and send messages to peripherals via the communication bus in a standalone mode, in particular without integration of the network structure 1 in an LMS.

Figure 3:
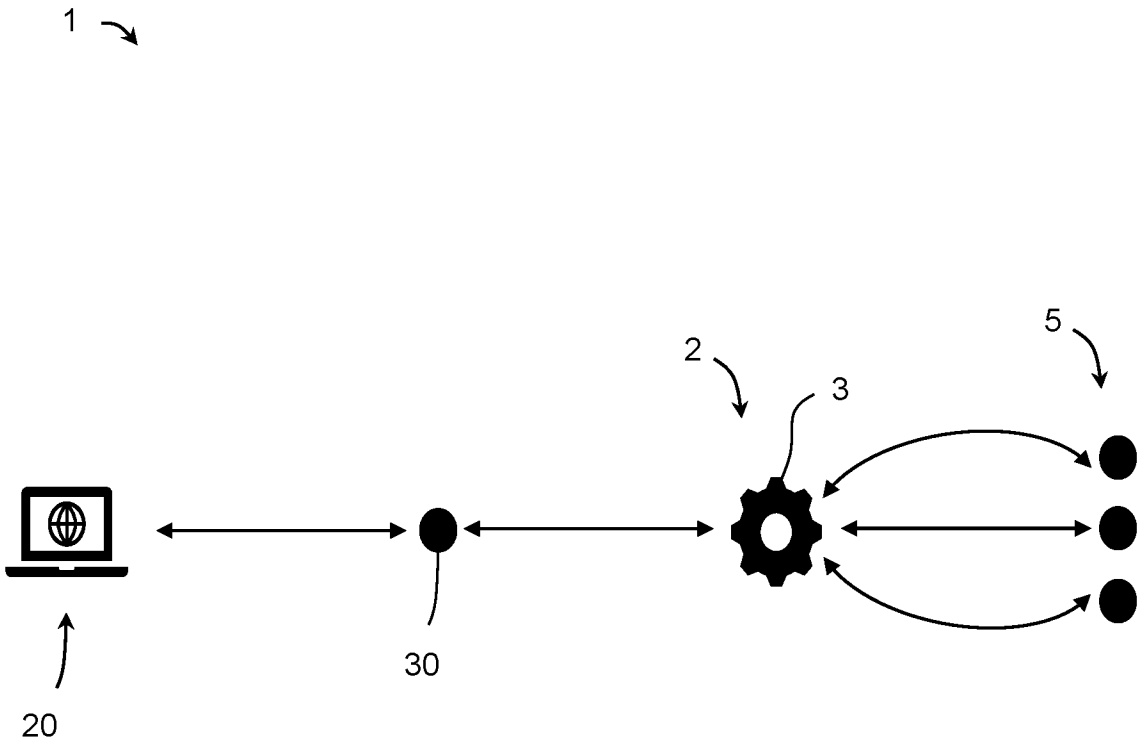

FIG. 3 schematically shows a network structure according to another embodiment. The network structure 1 of FIG. 3 corresponds essentially to the network structure 1 of FIG. 2 and additionally has an extension module in the form of a communication module 30, via which the network structure 1 can be connected to an LMS 20 (shown symbolically). The further extension modules 5, which are designed as functional devices, are connected to the communication module 30 via the logic unit 3. The connection between the functional devices and the communication module 30 can be flexibly designed via the logic unit 3. In particular, the functional devices can be assigned to the communication module 30 via the logic unit 3 individually, in groups or not at all. In particular, the logic unit 3 can be configured to, after detecting a communication module 30 connected to the communication bus 4, configure it accordingly and initialise it for participation in a corresponding LMS 20. The flowchart of FIG. 6 below shows the corresponding process flow.

Figure 4:
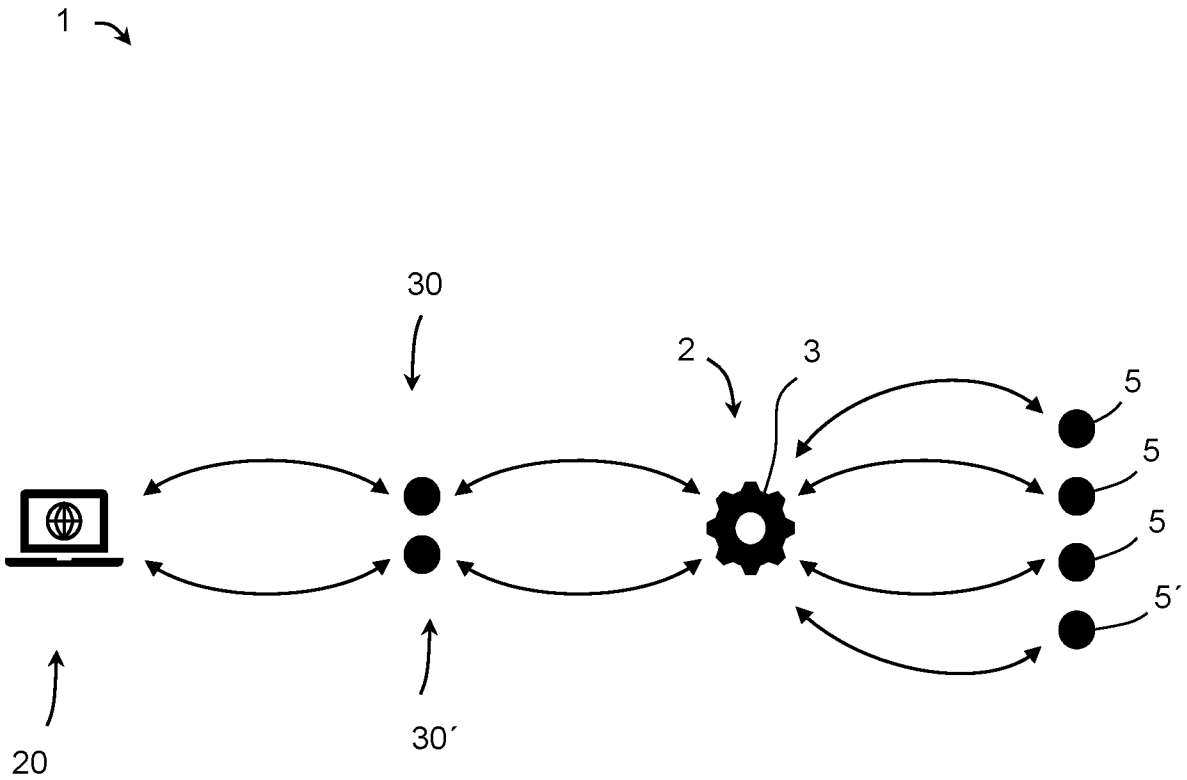

FIG. 4 schematically shows a network structure according to a further embodiment. The network structure 1 of FIG. 4 corresponds essentially to the network structure 1 of FIG. 3 and additionally has a further communication module 30'. Thus, in addition to a first communication module 30, the network structure 1 of FIG. 4 has a second communication module 30', wherein the network structure 1 can be connected to an LMS 20 (shown symbolically) via the first communication module 30 and the second communication module 30'. The embodiment shown in FIG. 4 corresponds in particular to the case when the number of functional devices reaches the limit of a communication module for proper operation in an LMS, according to which a further communication module of the same type is attached to the logic. The logic unit 3 may in particular be configured to be connected to a plurality of communication modules 30, 30' via the communication bus 4 so as to ensure proper operation of multiple functional devices in an LMS. In particular, the logic unit 3 may be configured to assign functional devices to individual communication modules 30, 30' so that the network structure 1 can be easily scaled by accommodating additional functional devices. For example, some expansion modules 5 or functional devices can be assigned to the first communication module 30 and other expansion modules 5' or functional devices can be assigned to the second communication module 30'.

Figure 5:
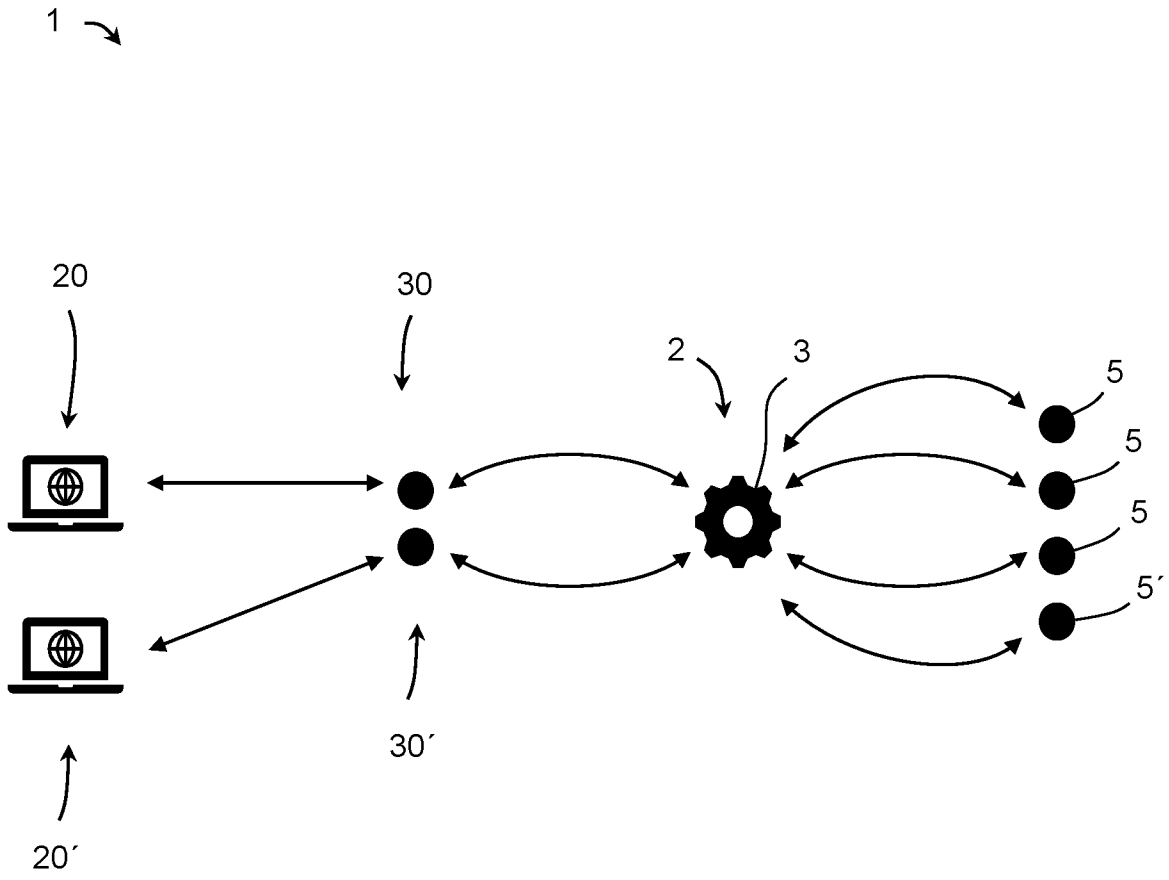

FIG. 5 schematically shows a network structure according to another embodiment. The network structure 1 of FIG. 5 corresponds essentially to the network structure 1 of FIG. 4. Here, FIG. 5 refers to an application when the customer is given the option of displaying the extension modules 5, 5' or functional devices connected to the logic unit 3 alternatively or simultaneously in two LMS 20, 20'. For this purpose, according to the embodiment shown, two different communication modules 30, 30' are used, which can be configured by the logic unit 3. In this case, the logic unit 3 changes to a multi-master mode operation due to the simultaneous existence of two different LMS 20, 20'.

The network setups described in FIGS. 1, 3, 4 and 5 above can be designed to subsequently calibrate a luminaire for more precise colour control and optimised maintenance. For example, the measurements can be performed on luminaires with the same luminaire type provided and the calibration data can be made available to the existing installation as an online update. For this option, an extension module or peripheral is installed or if necessary used in the installation, which has an "online update" capability (e.g. ZigBee peripheral). This calibration data may include, in particular, information on the warmest and coldest colour temperature, the nominal luminous current and the power of the luminaire, and/or a Colour Rendering Index (CRI), as well as information on manufacturers, etc. An implementation example of such a subsequent calibration is shown as a flow chart in FIG. 7.

Figure 6:
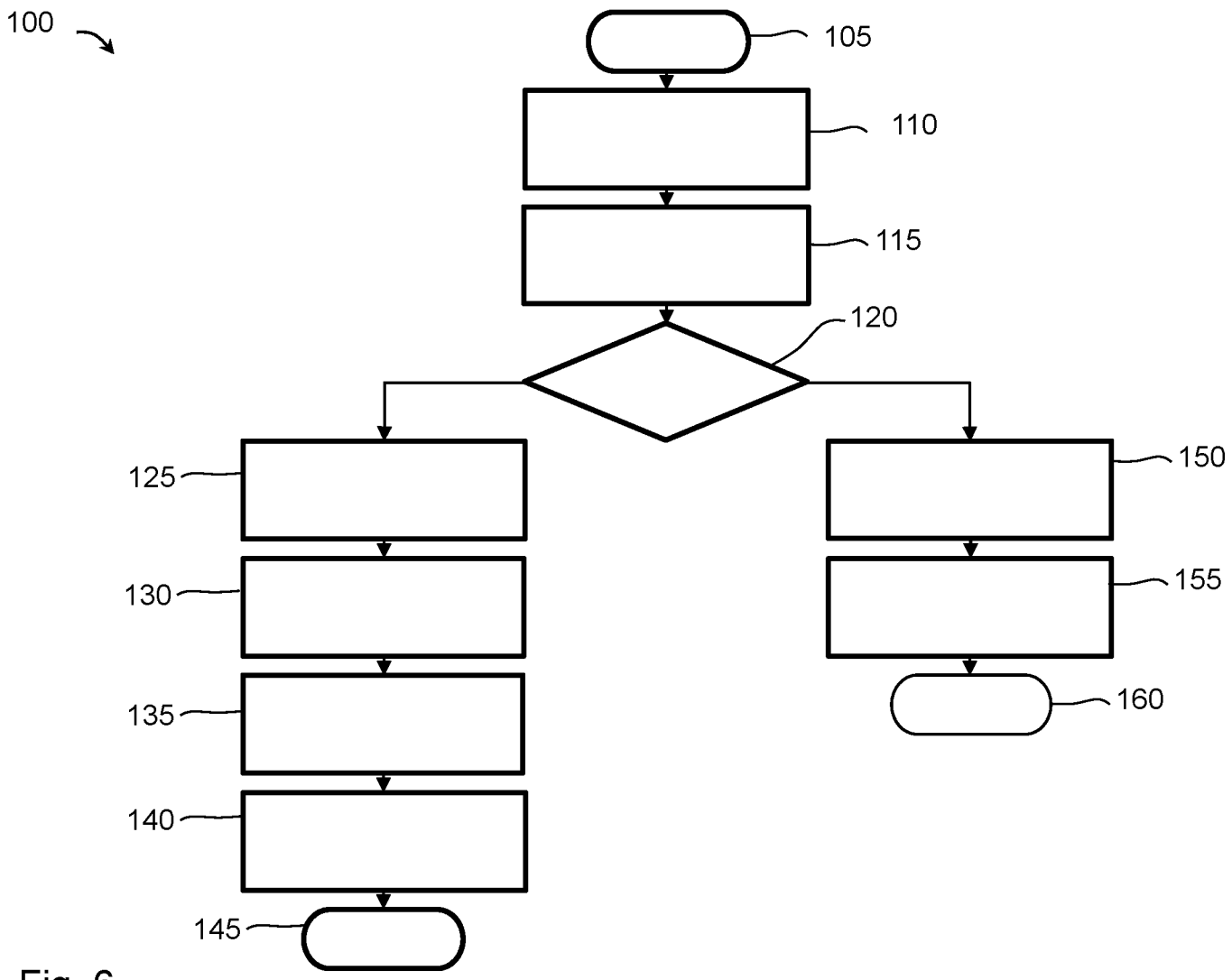
FIG. 6 shows a flowchart of a method for configuring an expansion module according to an embodiment.

FIG. 6 shows a flowchart of a method for configuring an expansion module according to an embodiment. The method 100 for configuring an expansion module or peripheral shown in FIG. 6 can be executed in particular in one of the network setups shown in FIGS. 1, 3, 4, and 5. According to the embodiment example of the method 100 shown in FIG. 6, after a start 105 of the method 100, in the method step 110 a search is made for a peripheral or an extension module 5 connected to the base module 2, in particular via the communication bus 4. In the subsequent step 115, the peripheral or extension module 5 found is configured for the communication bus. By configuring the extension module in the method step 115, the extension module 5 or peripheral is enabled to participate in the communication via the communication bus 4. In a query step 120, it is queried whether the expansion module or peripheral found is a communication module.

If the query in step 120 shows that the extension module 5 found is a communication module, then in method step 125 the communication module can be designated to represent a functional device already present in the network structure 1 in an LMS. In method step 130, the peripheral or communication module 30 is then notified of the type of functional device to be represented. In the method step 135, the factory settings of the functional device necessary for participation in the LMS are then sent to the communication module 30. In the method step 140, the peripheral or the communication module found is activated for participation in the LMS. The method 100 for configuring the expansion module is then terminated with the method step 145.

If the query step 120 shows that the extension module is not a communication module, the extension module is recognised as a functional device in the method step 150. In the following method step 155, the functional device is initialised and the method is ended with the method step 145.

Figure 7:
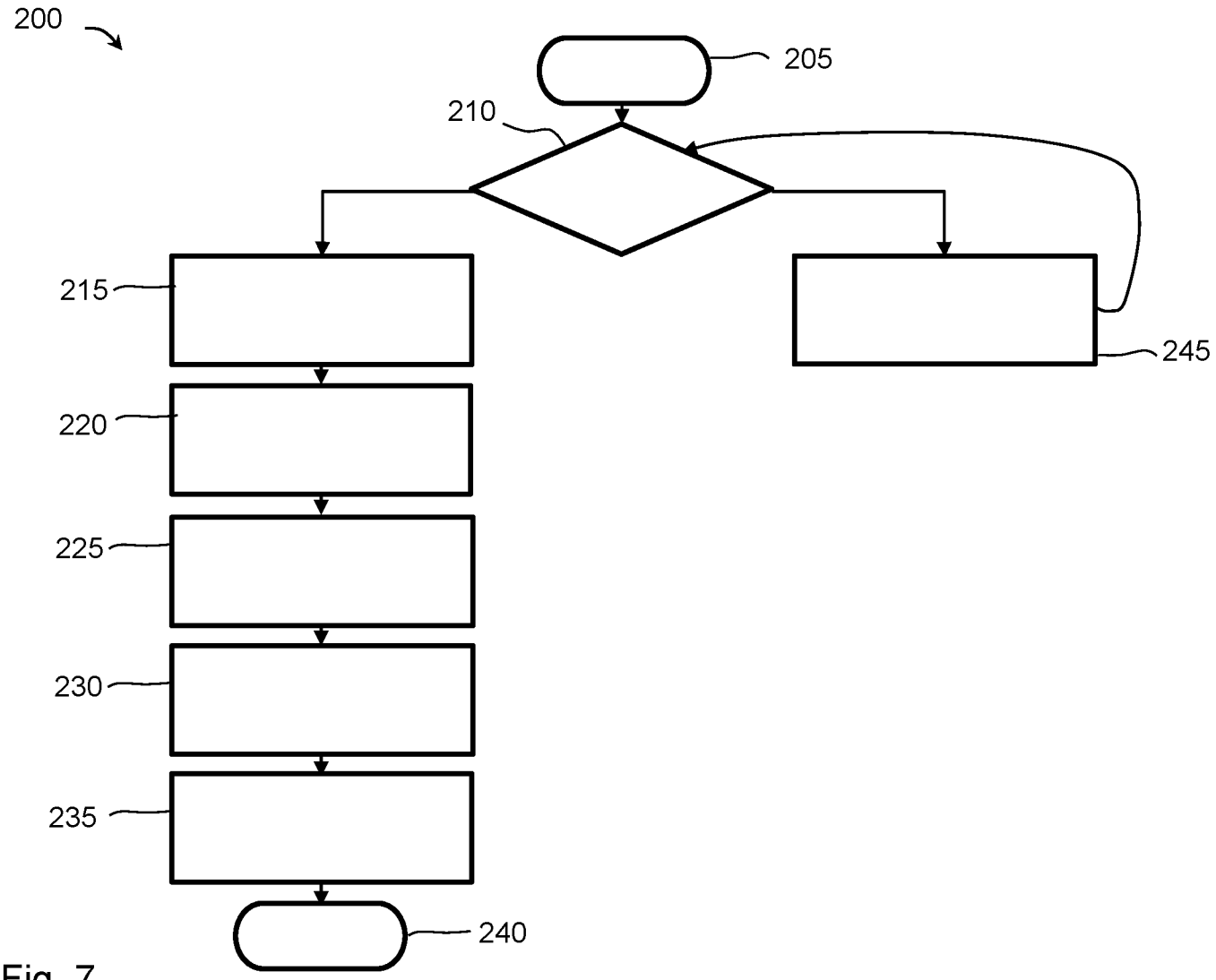
FIG. 7 shows a flow chart of a method for calibrating a luminaire.

FIG. 7 shows a flowchart of a method for calibrating a luminaire. In particular, the method 200 shown in FIG. 7 can be performed to calibrate a luminaire having an internal architecture according to one of the network setups shown in FIGS. 1 to 5. According to the embodiment of the method 200 shown in FIG. 7, after a start 205 of the method 200, a query 210 is performed by the logic unit 3 as to whether a luminaire is present or connected to the communication bus. If the query 210 shows that a luminaire is present, a luminaire, in particular of the same luminaire type, is measured for calibration in the method step 215. In method step 220, calibration data are acquired and in method step 225, the acquired calibration data are transmitted to an online-capable peripheral or communication module of the network structure. In the following step 230, the logic unit 3 is informed of the data received and the control, in particular the colour control of the luminaire, is adjusted accordingly. In method step 235, the luminaire data is made available to the LMS and the method is ended with the method step 240. If the query in step 120 shows that no luminaire, in particular no luminaire with the required luminaire type, is available, a luminaire is requested to be measured in method step 245.

This calibration option allows customers to minimise the logistical effort associated with commissioning an LMS. This is because usually the luminaires with an LED driver are individually calibrated in the factory. With the luminaires described here, the luminaires can be purchased flexibly, in particular from desired manufacturers, and only calibrated subsequently, in particular according to the calibration method described above.

In addition to the possibility of subsequent factory-independent calibration, the platform design-based network setups described above offer a number of advantages. Such network setups or systems can, for example, be easily scaled up by connecting further expansion modules, in particular functional devices and/or communication modules, to the communication bus. Furthermore, functional devices can be used flexibly, as required, in different networks or LMSs or in a standalone device or luminaire. Furthermore, due to the flexibility of the communication modules, different functional devices can be integrated into an LMS both individually and simultaneously. The modularity of the network structure simplifies the change from one, for example outdated, LMS, to another, in particular future-proof, LMS, without having to discard the already existing functional devices. In addition to direct economic advantages, this can be of decisive importance for both luminaire manufacturers and also customers, especially with regard to the "circular economy" and ever stricter environmental regulations. The ability to subsequently calibrate the luminaires in particular makes it possible to achieve precise light colour control and high-quality Human Centric Lighting (HCL), for example by imitating daylight particularly realistically.

Figure 8:
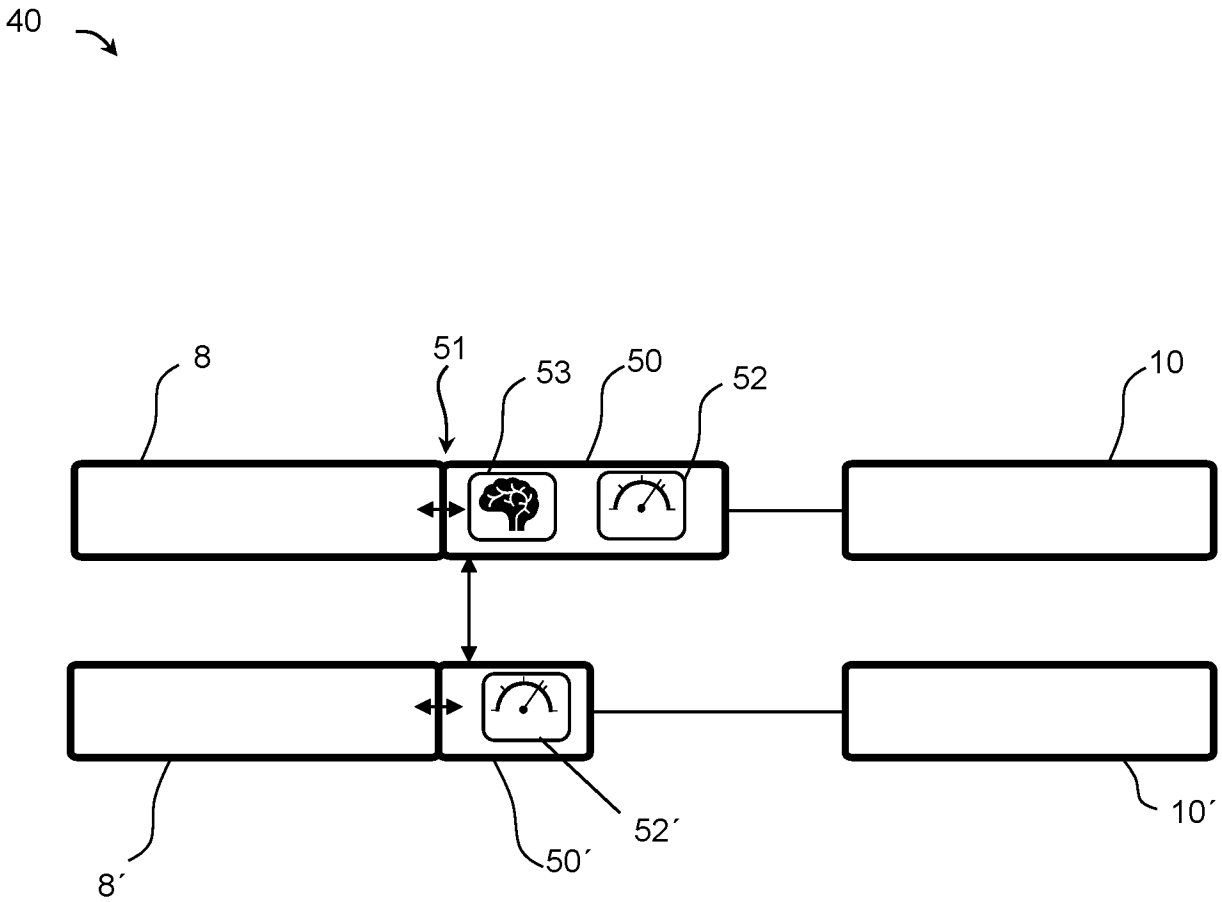
FIG. 8 shows a driver system according to an embodiment.

FIG. 8 shows a driver system according to an embodiment. The driver system 40 shown in FIG. 8 comprises a first driver 8 with a first driver extension module 50 and a second driver 8' with a second driver extension module 50'. The drivers 8 and 8' are designed as LED drivers with adjustable output voltage and with adjustable output current, respectively.

The first driver expansion module 50 and the second driver expansion module 50' are designed for retrofitting the first driver 8 and the second driver 8' respectively and each have an interface 51, 51' for connecting the first driver expansion module 50 and the second driver expansion module 50' to the first driver 8 and the second driver 8' respectively. The first driver expansion module 50 and the second driver expansion module 50' are connected in each case on the output side to the first driver 8 and the second driver 8' respectively.

FIG. 8 further shows a first light engine 10 and a second light engine 10' which can be driven by the driver system and by the first driver 8 and the second driver 8', respectively.

In the embodiment of FIG. 8, the driver expansion modules 50, 50' each have a sensor system 52, 52' for detecting the output voltage of the first driver 8 and the second driver 8', respectively. The first driver expansion module 50 also has a logic 53 or control unit.

There is a functional connection or data and/or signal communication between the first driver 8 and the first driver extension module 50, between the second driver 8' and the second driver extension module 50' and between the first driver extension module 50 and the second driver extension module 50', which is shown schematically in FIG. 8 by a double arrow in each case. The logic 53 is designed to evaluate the data detected by the sensor system 52, 52' and to send control signals to a control input (not shown) of the first driver 8 or the second driver 8' for controlling the first driver 8 or the second driver 8'.

The logic 53 may be configured to determine a current value of a JT of an LED based on an output voltage of the driver detected by the sensor system 52, 52' and to adjust the output current of the first driver 8 or the second driver 8' according to the current value of the JT.

Figure 9:
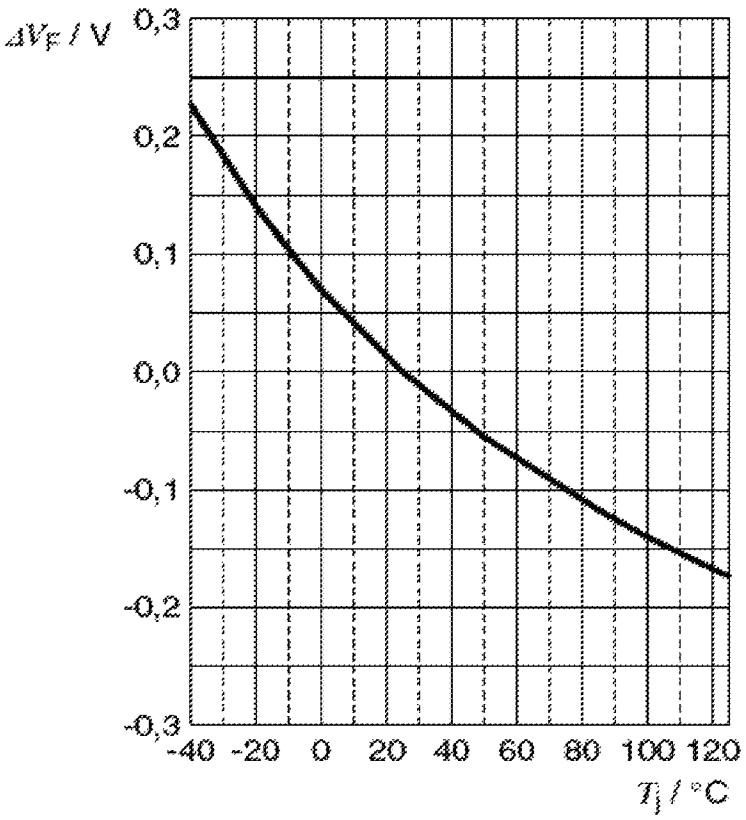
FIG. 9 shows a dependence between temperature and forward voltage of an LED.

FIG. 9 shows a dependency between temperature and forward voltage of an LED. The dependency between the temperature or JT of the LED and the forward voltage shown in FIG. 9 based on the relative change of the forward voltage ΔVF/V shows that there is a clear correlation between the forward voltage and the JT. If the forward voltage is measured during operation of the LED, the JT of the LED can be calculated from this, for example with a look-up table stored in the memory unit in which this dependency between the forward voltage and the JT is stored.

Figure 10:
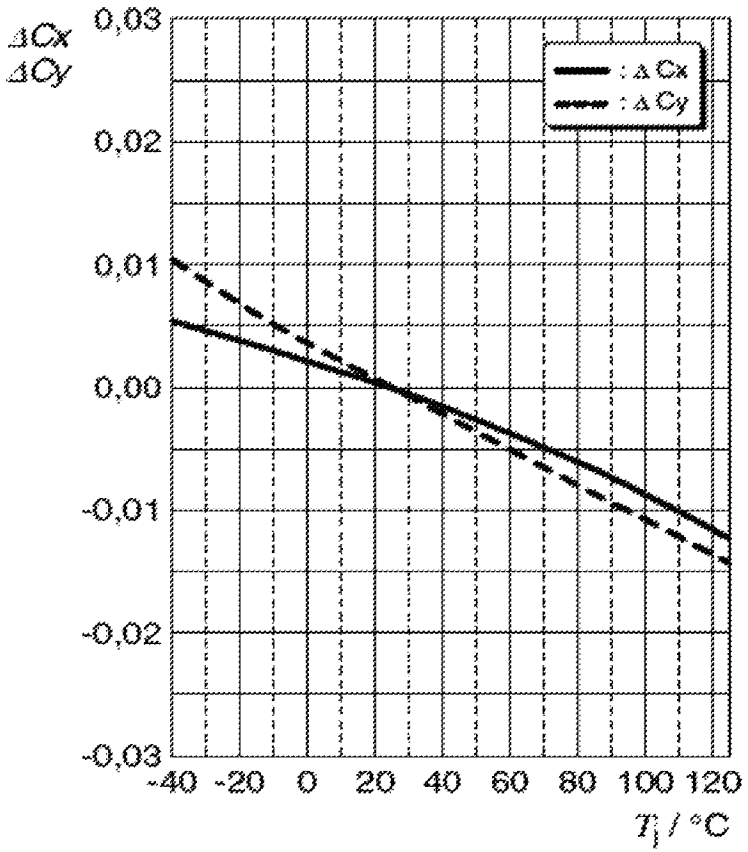
FIG. 10 shows a dependency between temperature and colour shift of an LED.

FIG. 10 shows a dependency between temperature and colour shift of an LED. The dependency between the temperature or JT of the LED and that of the colour shift shown in FIG. 10 based on the relative change of the colour coordinates ΔCx and ΔCy of the forward voltage shows that the colour location of the LED shifts at different temperatures. In the case of a light engine with warm and cool white LEDs for mixing a defined colour temperature, this leads to a deviation from the setpoint. If the temperature and the colour shift of both LED types are known, the control signal is adapted, in particular with a two- or multi-channel driver or with a driver system as shown in FIG. 8, so that unwanted colour shifts can be suppressed or reduced. The curves shown in FIGS. 9 and 10 can be taken from the data sheets of the commercially available LED (GW JTLPS1.EM) from Osram. However, other LEDs also have such or similar temperature dependencies of the forward voltage or colour shift. In particular, these dependencies can be stored in the memory unit of the logic or control unit so that the deviations occurring during LED operation can be actively corrected using the current values of the output voltage detected by the sensor system.

The retrofittability of the drivers with the driver expansion modules results in cost savings. This is because drivers without driver extension modules can continue to be used, in particular for applications with low requirements for driver functionality. In addition, the driver extension modules are not limited to a specific driver type but can be used across different driver types.

By detecting the output voltage and/or output current of the drivers, information about the output power can also be obtained, which can be used for energy reporting or energy consumption monitoring and control, for example. Furthermore, the information about the output voltage can be used to create an overtemperature protection for the light engine. In this case, the current is regulated down if the forward voltage measurement shows a too high LED temperature. The data analysis and control of the driver takes place in the add-on module or driver extension module. The measurements can also be used for active and precise power derating of the driver, wherein the maximum setpoint of the current is limited with the measured actual value of the voltage so that the nominal power of the driver is not exceeded.

Although at least one exemplary embodiment has been shown in the foregoing description, various changes and modifications may be made. The aforementioned embodiments are examples only and are not intended to limit the scope, applicability or configuration of the present disclosure in any way. Rather, the foregoing description provides the person skilled in the art with a plan for implementing at least one exemplary embodiment, wherein numerous changes in the function and arrangement of elements described in an exemplary embodiment may be made without departing from the scope of protection of the appended claims and their legal equivalents. Furthermore, according to the principles described herein, several modules or several products can also be connected with each other in order to obtain further functions.

The invention claimed is:

1. A driver expansion module for retrofitting a driver with at least one adjustable output parameter, comprising:

an interface for connecting the driver expansion module to the driver; and a control unit, wherein the control unit is configured to send a control signal to a control input of the driver to adjust the at least one adjustable output parameter of the driver, and wherein the driver expansion module is configured to allow an output current of the driver to flow via the driver expansion module.

2. The driver expansion module according to claim 1, wherein the driver expansion module further comprises a sensor system for detecting a current value of the at least one adjustable output parameter, and wherein the control unit is configured to adjust the at least one adjustable output parameter of the driver based on the detected current value.

3. The driver expansion module according to claim 2, wherein the control unit is configured to determine a current value of a junction temperature of a light emitting diode (LED) based on an output voltage of the driver detected by the sensor system and to adjust the at least one adjustable output parameter of the driver based on the current value of the junction temperature.

4. The driver expansion module according to claim 1, wherein the driver expansion module is configured to communicate with another driver expansion module for exchanging at least one of data and signals.

5. The driver expansion module according to claim 4, wherein the driver expansion module comprises a communication interface for at least one of wireless and wired communication, so that communicating with the other driver expansion module is done via the communication interface.

6. The driver expansion module according to claim 1, wherein the driver expansion module is configured to communicate with another driver expansion module via a network interface of the driver for connecting the driver to a base module of a network assembly.

7. A driver having at least one adjustable output parameter, wherein the driver comprises an interface for connecting a driver expansion module and a control input for receiving a control signal from the driver expansion module, and wherein the driver is configured to adjust the at least one output parameter based on the control signal received from the driver expansion module.

8. The driver according to claim 7, wherein the driver comprises a network interface for connecting the driver to a base module of a network assembly via a communication bus.

9. A driver system, comprising:

a first driver having at least one first adjustable output parameter, wherein the first driver has a first interface for connecting a first driver expansion module and a first control input for receiving a first control signal from the first driver expansion module for adjusting the at least one first adjustable output parameter, and wherein the first driver expansion module is configured such that a first output current of the first driver flows via the first driver expansion module; and a second driver having at least one second adjustable output parameter, wherein the second driver has a second interface for connecting a second driver expansion module and a second control input for receiving a second control signal from the second driver expansion module for adjusting the at least one adjustable second output parameter, and wherein the second driver expansion module is configured such that a second output current of the second driver flows via the second driver expansion module;

wherein the first driver is configured to drive a first electrical load and the second driver is configured to drive a second electrical load.

10. The driver system according to claim 9, wherein at least one of the first driver expansion module and the second driver expansion module comprises a sensor system for detecting a current value of at least one adjustable output parameter of the first driver and the second driver, respectively, and wherein the first driver expansion module and the second driver expansion module, respectively, are configured to adjust the at least one adjustable output parameter of the first driver and the second driver, respectively, based on the detected current value of the at least one adjustable output parameter.

11. The driver system according to claim 9, wherein the first driver expansion module and the second driver expansion module are configured to communicate with each other for exchanging at least one of data and signals.

12. The driver system according to claim 11, further comprising a network assembly having a base module and a communication bus, wherein the first driver and the second driver are connected to the communication bus of the network assembly so that communication between the first driver expansion module and the second driver expansion module takes place via the first driver, via the communication bus of the network assembly, and via the second driver.

13. The driver system according to claim 9, wherein the first driver expansion module is configured to send a control signal to the second driver expansion module that causes the second driver expansion module to drive the second driver based on the control signal received from the first driver expansion module.

14. The driver system according to claim 9, wherein the first driver expansion module and the second driver expansion module each comprise a sensor system, and wherein the second driver expansion module is configured to transmit sensor data detected by the sensor system of the second driver expansion module to the first driver expansion module, wherein the first driver expansion module is configured to send control signals to the second driver expansion module that cause the second driver expansion module to drive the second driver based on the sensor data detected by the sensor system of the first driver expansion module and the sensor data detected by the sensor system of the second driver expansion module.

15. A light management system comprising a first light source, a second light source, and the driver system according to claim 9, wherein the first driver of the driver system is adapted to drive the first light source and the second driver is adapted to drive the second light source, and wherein the light management system comprises a network structure having a base module and a communication bus to which the first driver and the second driver are connected.

16. The driver expansion module according to claim 1, wherein the driver expansion module is configured to serve a driver with multiple output channels.

17. A luminaire or luminaire system comprising the driver expansion module according to claim 1.

18. A luminaire or luminaire system comprising the driver according to claim 7.

19. The driver according to claim 8, wherein the communication bus is an internal communication bus.

20. A luminaire or luminaire system comprising the driver system according to claim 9.

* * * * *